US007464825B2

(12) United States Patent
Johnston et al.

(10) Patent No.: US 7,464,825 B2
(45) Date of Patent: Dec. 16, 2008

(54) PRESSURE RESISTANT BASE

(75) Inventors: Richard Johnston, Toledo, OH (US); Doug Struble, Maumee, OH (US); Debra Finnigan, Toledo, OH (US)

(73) Assignee: Graham Packaging Company, L.P., York, PA (US)

( * ) Notice: Subject to any disclaimer, the term of this patent is extended or adjusted under 35 U.S.C. 154(b) by 630 days.

(21) Appl. No.: 11/000,357

(22) Filed: Dec. 1, 2004

(65) Prior Publication Data

US 2006/0113308 A1 Jun. 1, 2006

(51) Int. Cl.
*B65D 1/42* (2006.01)
*B65B 1/04* (2006.01)

(52) U.S. Cl. ..... 215/373; 215/371; 220/606; 220/608; 53/476

(58) Field of Classification Search ..... 215/371–373, 215/375; 220/608, 609, 606; 53/467
See application file for complete search history.

(56) References Cited

U.S. PATENT DOCUMENTS 3,917,095 A 11/1975 Seefluth
5,217,737 A * 6/1993 Gygax et al. ..... 426/111
5,269,437 A * 12/1993 Gygax ..... 220/606
5,492,245 A 2/1996 Kalkanis
5,819,507 A 10/1998 Kaneko
6,672,470 B2 * 1/2004 Wurster et al. ..... 215/373
7,055,711 B2 * 6/2006 Sasaki et al. ..... 215/373
2003/0178386 A1 9/2003 Maczek
2004/0144748 A1 7/2004 Slat et al.
2004/0164045 A1 * 8/2004 Kelley ..... 215/373
2004/0211746 A1 10/2004 Trude
2004/0232103 A1 11/2004 Lisch et al.

FOREIGN PATENT DOCUMENTS

EP 0865898 9/1998
GB 2040256 8/1980
JP 10034880 2/1998

* cited by examiner

*Primary Examiner*—Sue A Weaver
(74) *Attorney, Agent, or Firm*—Knoble, Yoshida & Dunleavy, LLC

(57) ABSTRACT

A base structure having a bearing surface defining a bearing plane and an inner portion spaced apart from the bearing surface in a direction that is substantially perpendicular to the bearing plane. The inner portion includes a first surface, a second surface spaced apart from said first surface, and a step merging said first surface with second surface.

11 Claims, 6 Drawing Sheets

PRESSURE RESISTANT BASE

BACKGROUND OF THE INVENTION

1. Field of the Invention

The present invention relates generally to a container base for enhancing the structural integrity of the base.

2. Related Art

Plastic containers, such as polyolefin containers, can be used for packaging snack dry food. It is understood by a person having ordinary skill in the art that to form such polyolefin containers, a parison can be heated in an extruder, captured by a mold, and blown in the mold. Specifically, to form the cavity of the container, a parison can be extruded up into the mold and as the mold comes together, a pneumatic blow pin, for example, can pierce the parison and blow the parison up against the walls of the mold. The mold typically contains flash pockets above and below the cavity in the mold to capture the excess parison above and below the cavity. It can be understood by a person having ordinary skill in the art, that as the parison is blown inside the mold and captured in the flash pockets, portions of the parison must adhere together. Once the container is cooled, the excess flash can then be cut away from the container after being ejected from the mold.

Dry food containers can be filled at altitudes at or below sea level and then fitted with an airtight seal. When these containers are subsequently shipped, they must be able resist deformation caused by changes in external air pressure that can cause changes in the internal pressure of the container. For example, when the containers are shipped at high altitudes, e.g., across mountains, the external pressure can drop such that the containers have an increased effective internal pressure.

Such an increase in effective internal pressure can cause the bases of the containers to distort. Often times, an inner portion of the base will distort below the intended bearing surface of the base. When such distortion occurs, the container tends to rock on the inner portion of the base instead of standing upright on the bearing surface of the base.

What is needed, then, is a plastic container having a base design that is capable of withstanding changes in pressure without distortion below the bearing surface of the base.

BRIEF SUMMARY OF THE INVENTION

Exemplary embodiments of the invention provide a container having a base structure that is resistant to deformation when the internal pressure of the container increases. In one embodiment of the invention, a base structure may include a bearing surface defining a bearing plane and an inner portion spaced apart from the bearing surface in a direction that is substantially perpendicular to the bearing plane. The inner portion may include a first surface, a second surface spaced apart from said first surface, and a step merging said first surface with said second surface.

In a further embodiment of the invention, a plastic container may include a base structure having a bearing surface defining a bearing plane and an inner portion spaced apart from the bearing surface in a direction that is substantially perpendicular to the bearing plane. The inner portion may include a first surface, a second surface spaced apart from said first surface, and a step merging said first surface with said second surface. The container may also include a sidewall for merging with said base and an opening for receiving and pouring contents of the container.

In still a further embodiment of the invention, a method of packaging a product may be provided. The method may include providing a plastic container having a base structure according to embodiment of the present invention, placing the product into the container; and providing an air tight seal over a mouth of the container.

Further objectives and advantages, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

Figure 1:
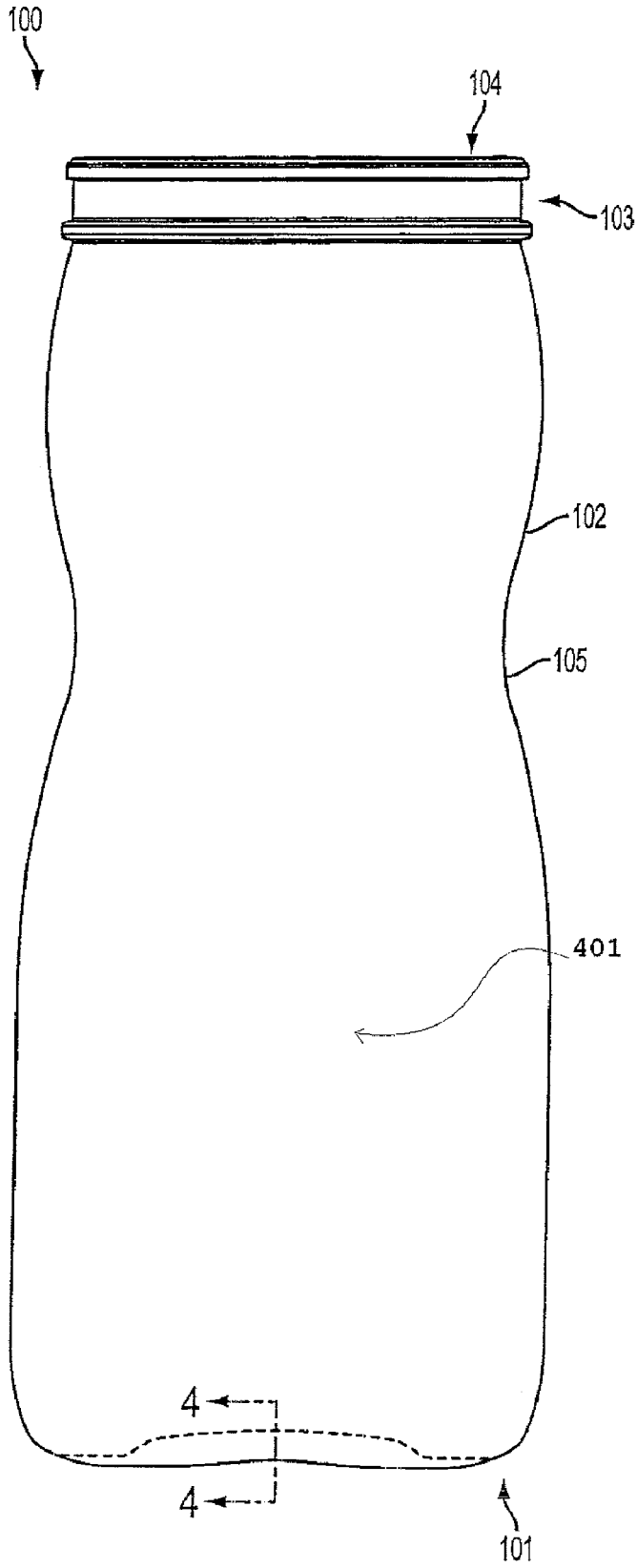
FIG. 1 depicts a front view of an exemplary embodiment of a plastic container according to the present invention.
Figure 2:
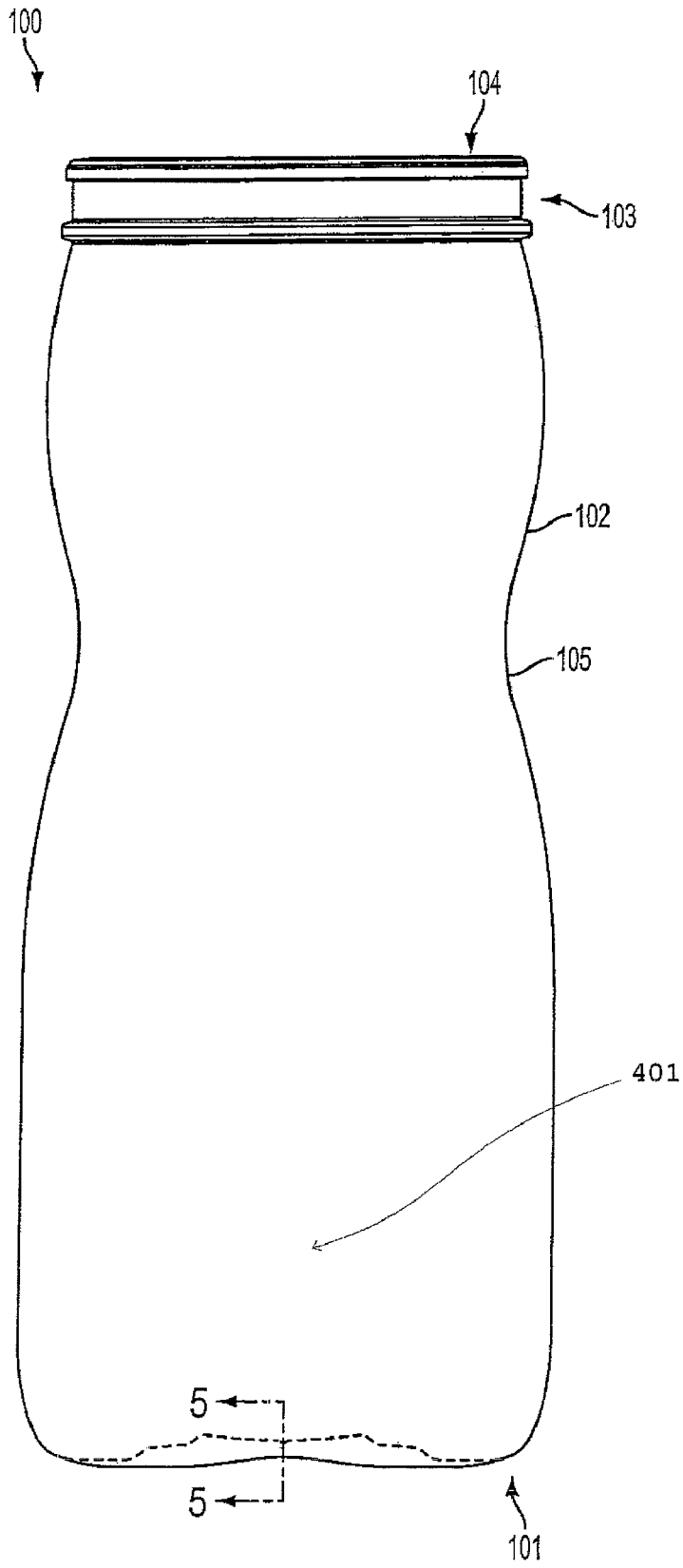
FIG. 2 depicts a front view of an exemplary embodiment of a plastic container according to the present invention.

Referring to the Figures, an exemplary embodiment of a container 100 may include a base 101, a sidewall 102 merging with the base 101 and forming a cavity, a finish 103 having an opening 104 for receiving and pouring the contents of the container. In an exemplary embodiment as shown in FIGS. 1 and 2, for example, sidewall 102 may be substantially cylindrical or tubular.

In an exemplary embodiment of the invention, container 100 may have a waist 105 for providing a grip for the container, for example, and/or support for the container when multiple containers are stacked on top of one another. In a further embodiment of the container, opening 104 may be large enough in diameter so that a person, (e.g., a child) may insert his or her hand into the cavity of the container to retrieve the contents from the container. Container 100 may also have a lid (not shown) for sealing the container. Further, when a container such as container 100 contains dry snack foods, for example, a foil seal may be applied to the container so as to provide an air-tight seal of the container.

In an exemplary embodiment of the invention, as shown in FIGS. 3-7, for example, a base 101 according to exemplary embodiments of the present invention, may include a bearing surface 303, and an inner portion 311. Bearing surface 303 may include a bearing portion 309, an outer portion 310 for merging base 101 with sidewall 102, and a transitional portion 305.

Figure 3:
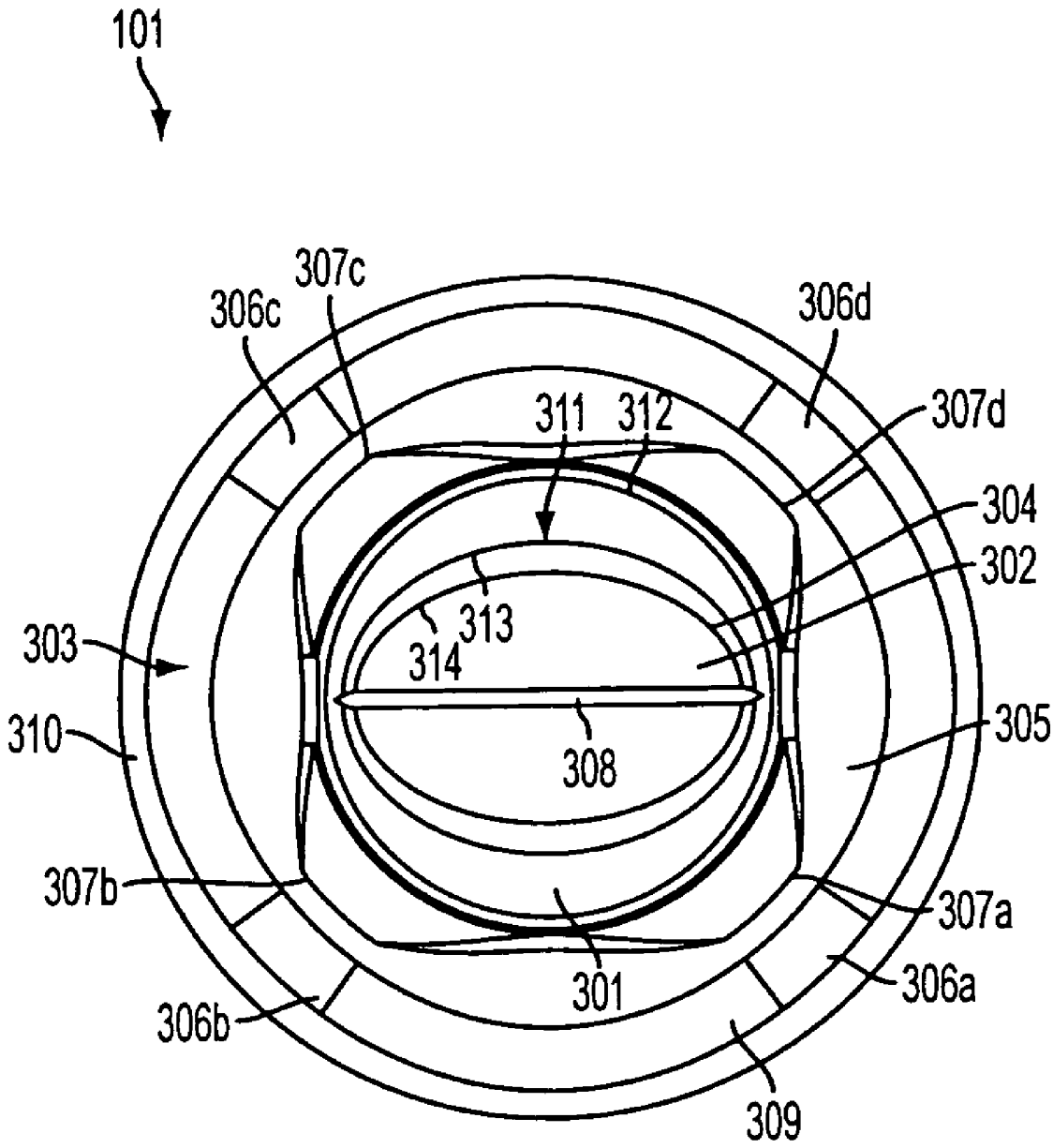
FIG. 3 depicts an exemplary embodiment of a base structure according to the present invention.

In an exemplary embodiment of the invention, bearing portion 309 may include touch points 306*a-d* for contact with a horizontal surface (not shown) upon which the upright container rests. In such an embodiment, transitional portion 305 may have a substantially rectangle (e.g., square) boundary with chamfered corners 307*a-d*, as shown in FIG. 3. Chamfered corners 307*a-d* may be positioned relative to touch points 306*a-d*, respectively, to further define the touch points. Although the exemplary embodiments shown depict a container having four touch points, one having ordinary skill in the art will understand that an embodiment of the present invention contemplates a bearing surface defining three touch points, for example. In such an embodiment, the shape of the transitional portion of the base structure may be, for example, a truncated triangle (not shown).

In an exemplary embodiment of the invention, touch points 306*a-d* define a bearing plane that is substantially coplanar with touch points 306*a-d*. Spaced apart from the bearing plane in a substantially perpendicular direction to the bearing plane can be inner portion 311. Inner portion 311 may include a first surface 301, a second surface 302, and a step 304.

In an exemplary embodiment of the invention, a sidewall 102 may merge with base 101. Base 101 may have a bearing surface 303, and recessed from the bearing surface 303 may be a first surface 301. A second surface 302 may be stepped-up from the first surface 301 via a step 304 to form the stepped-base as described in further detail below.

As shown in FIG. 3, for example, first surface 301 may have an outer boundary 312 that is substantially circular. In an exemplary embodiment of the invention, outer boundary 312 may merge with transitional portion 305. Further, first surface 301 may have an inner boundary 313 that is substantially elliptical. In such an embodiment, for example, first surface 301 may substantially surround second surface 302.

Figure 4:
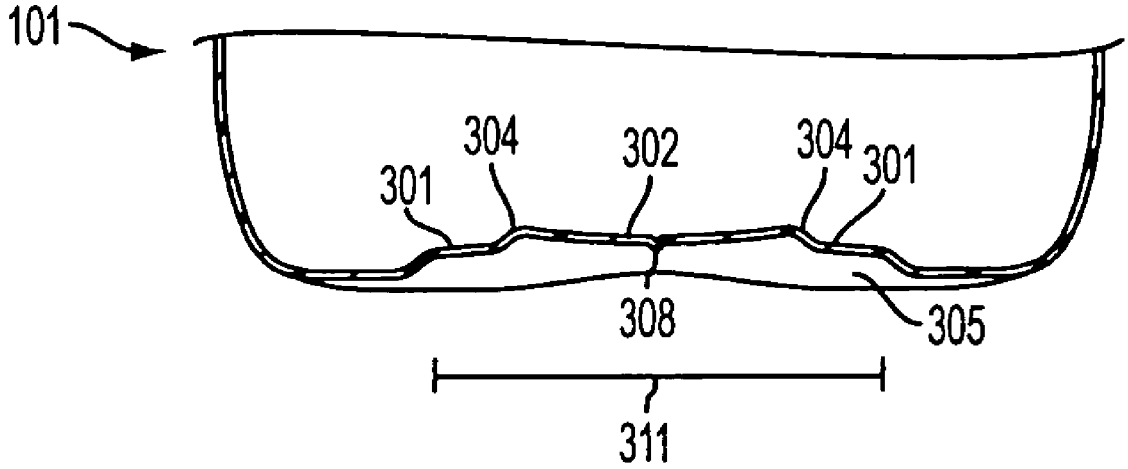
FIG. 4 depicts a cross sectional view along line 4-4 as shown in FIGS. 1 and 7 of an exemplary embodiment of a base structure according to the present invention.
Figure 5:
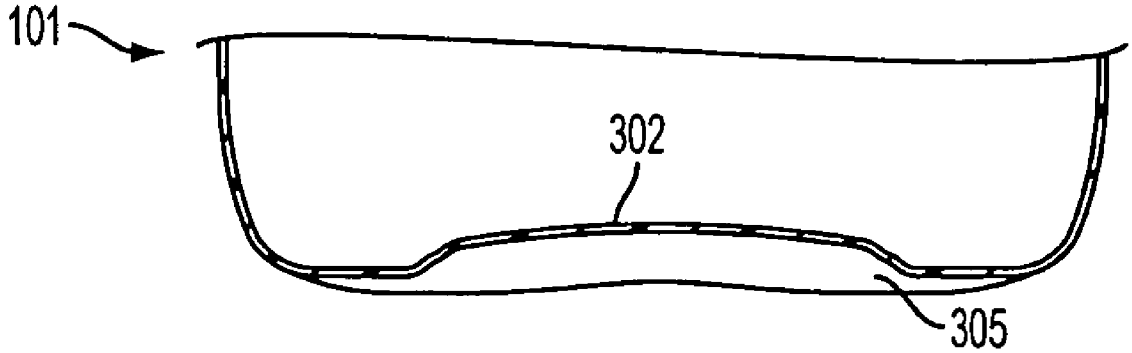
FIG. 5 depicts a cross sectional view along line 5-5 as shown in FIGS. 2 and 7 of an exemplary embodiment of a base structure according to the present invention.
Figure 6:
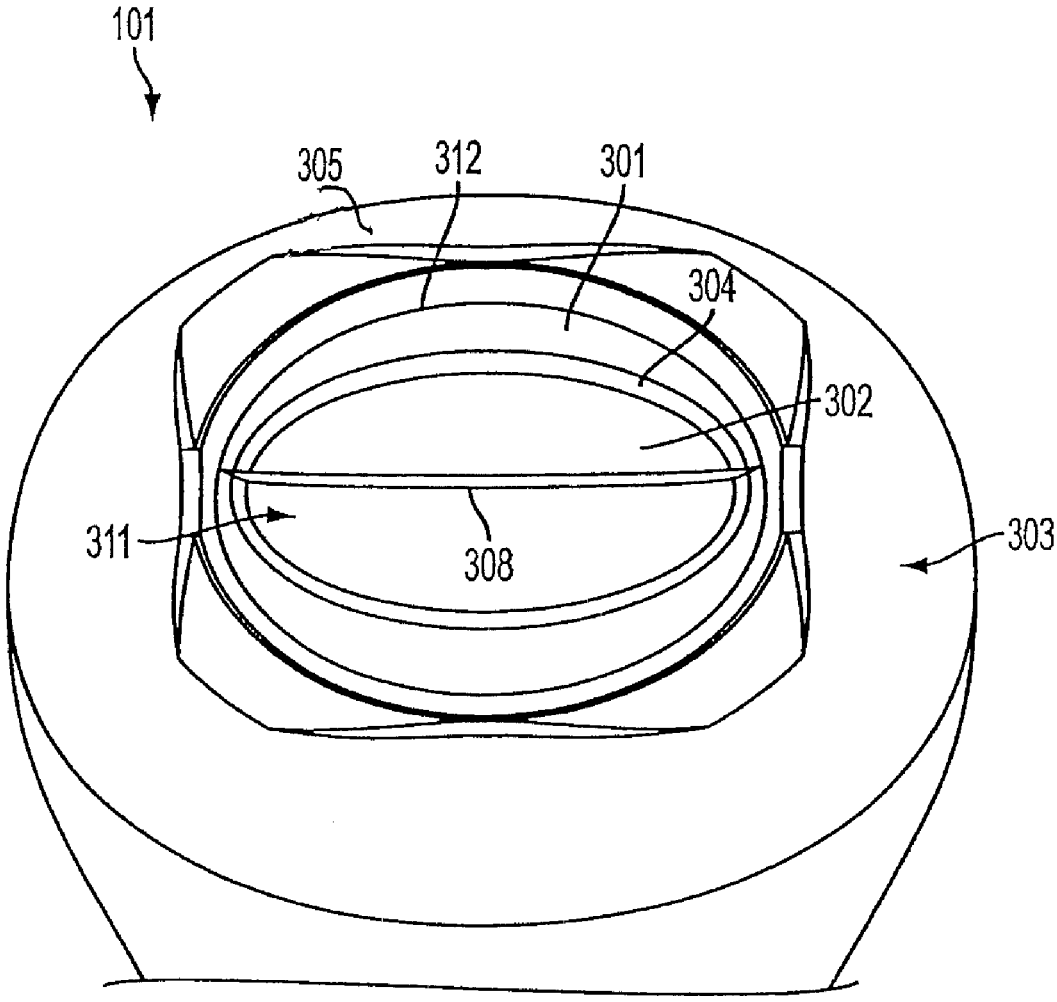
FIG. 6 depicts a perspective view of an exemplary embodiment of a base structure according to the present invention.
Figure 7:
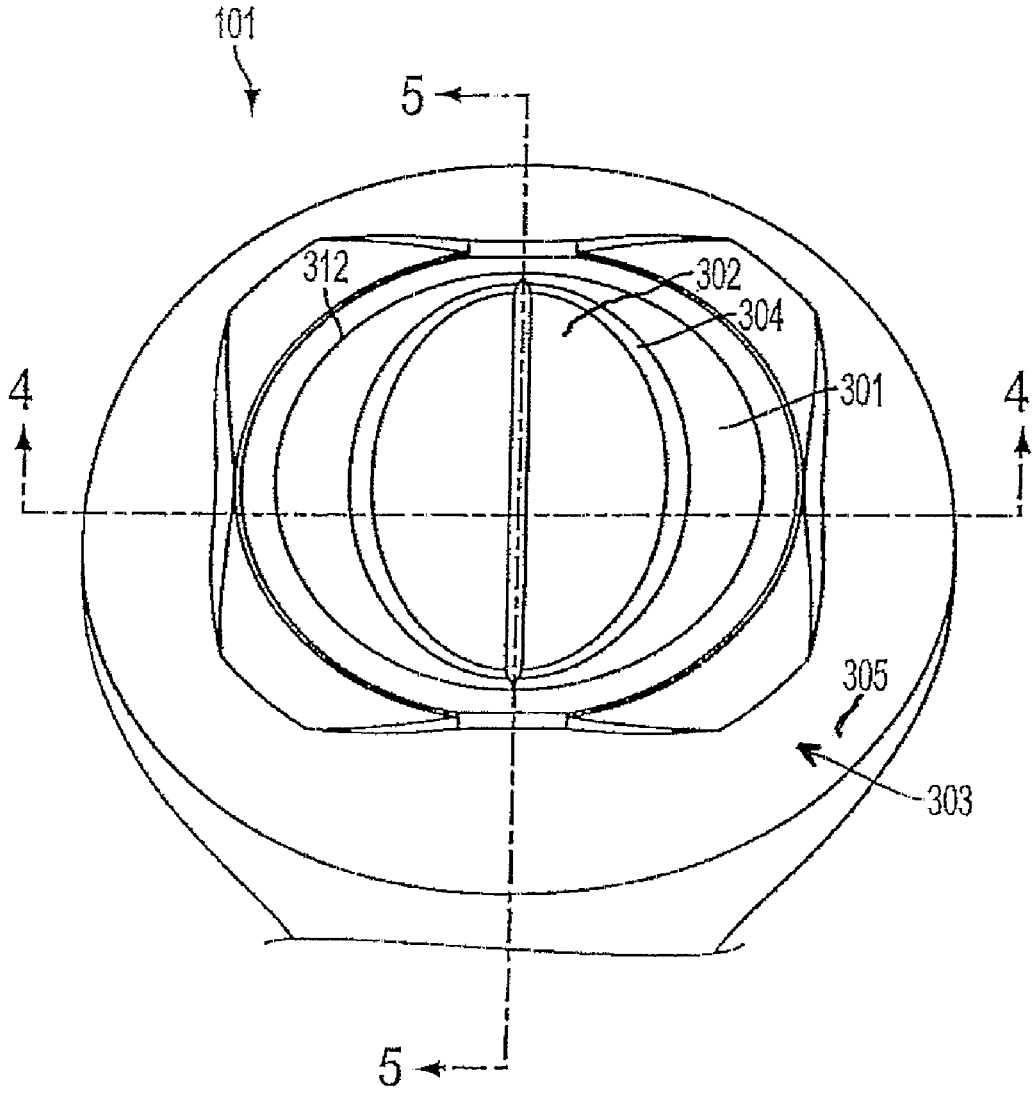
FIG. 7 depicts a perspective view of an exemplary embodiment of a base structure according to the present invention.

As shown in FIG. 4, for example, first surface 301 may be slightly concave in a direction that is substantially perpendicular to the bearing plane towards a cavity 401 of the container. Such a slight concavity may provide base 101 with sufficient structure to resist deformation of the base during an increase in internal pressure within the cavity when the container is sealed. In an exemplary embodiment of the invention, base 101 having a slightly concave first surface may withstand an increase in internal pressure of up to about 7 psi without any portion of the inner portion 311 extending beyond the bearing surface 303. When the inner portion includes only a single surface, for example in the absence of the second surface 302, the inner portion of the base may bulge at lower pressures, for example, at pressures below 3 psi.

In an exemplary embodiment of the invention, second surface 302 may have an inner boundary 314 that is substantially elliptical. In such an embodiment, step 304 may merge first surface 301 with second surface 302 such that second surface 302 is spaced further apart from the bearing plane in a substantially perpendicular direction to the bearing plane than first surface 301.

Additionally, in an exemplary embodiment of the invention, inner portion 311 may include a fin 308, which may be a result of the blow-molding process. As will be understood by a person having ordinary skill in the art, a fin, formed along the mold parting line, may enable the molten plastic to adhere when the molds come together. Further, fin 308 may provide additional structural support for the base of the container.

As shown in FIG. 4, for example, second surface 302 may be slightly convex in a direction that is substantially perpendicular to the bearing plane towards the bearing plane. Such a slightly convex surface may provide base 101 with sufficient structure to resist deformation of the base during an increase in internal pressure within the cavity when the container is sealed. In an exemplary embodiment of the invention, base 101 having a slightly convex second surface may withstand an increase in internal pressure of up to about 7 psi without any portion of the inner portion 311 extending beyond the bearing surface 303. Without such a slightly convex second surface, for example, the inner portion of the base may bulge at lower pressures, for example, at pressures below 3 psi.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A base structure for a plastic container, the base structure comprising: a bearing surface defining a bearing plane and; an inner portion spaced apart from the bearing surface in a direction that is substantially perpendicular to the bearing plane, said inner portion comprising a first surface, a second surface spaced apart from said first surface, and a step merging said first surface with said second surface; wherein an outer boundary of said second surface defines an ellipse having a major and minor axis, and wherein said second surface is slightly concave in a direction towards a cavity of the container along the major axis and slightly convex in a direction towards the bearing plane along the minor axis.

2. The base structure according to claim 1, wherein said bearing surface defines four touch points.

3. The base structure according to claim 1, wherein said inner portion further comprises a fin extending along a parting line of the base structure.

4. The base structure according to claim 1, wherein said inner portion provides resistance to distortion upon an increase of internal pressure within the container when the container is sealed.

5. The base structure according to claim 1, wherein said second surface is spaced further apart from the bearing plane in a substantially perpendicular direction to the bearing plane than the first surface.

6. A plastic container comprising: the base according to claim 1; a sidewall for merging with said base; and an opening for receiving and pouring contents of the container.

7. A base structure for a plastic container, the base structure comprising: a bearing surface defining a bearing plane and; an inner portion spaced apart from the bearing surface in a direction that is substantially perpendicular to the bearing plane, said inner portion comprising a first surface, a second surface spaced apart from said first surface, and a step merging said first surface with said second surface; wherein said bearing surface comprises an outer portion for merging with a sidewall of the container, a bearing portion for defining a plurality of touch points for contact with a horizontal surface, and a transitional portion for merging with said inner portion; wherein said bearing portion defines four touch points; and wherein said transitional portion includes a substantially circular inner boundary for merging with said inner portion with and an outer boundary defining a rectangle having chamfered corners for merging said bearing portion and further defining the four touch points.

8. The base structure according to claim 7, wherein said inner portion provides resistance to distortion upon an increase of internal pressure within the container when the container is sealed.

9. The base structure according to claim 7, wherein said second surface is spaced further apart from the bearing plane in a substantially perpendicular direction to the bearing plane than the first surface.

10. The base structure according to claim 7, wherein said inner portion further comprises a fin extending along a parting line of the base structure.

11. A method of packaging a product, comprising the steps of:

providing a container having a base structure comprising; a bearing surface defining a bearing plane and; an inner portion spaced apart from the bearing surface in a direction that is substantially perpendicular to the bearing plane, said inner portion comprising a first surface, a second surface spaced apart from said first surface, and a step merging said first surface with said second surface wherein an outer boundary of said second surface defines an ellipse having a major and minor axis, and wherein said second surface is slightly concave in a direction towards a cavity of the container along the major axis and slightly convex in a direction towards the bearing plane along the minor axis;

placing the product into the container; and providing an air tight seal over a mouth of the container.

* * * * *